US008007048B2

(12) United States Patent
Fader et al.

(10) Patent No.: US 8,007,048 B2
(45) Date of Patent: Aug. 30, 2011

(54) BREAKING OR EXCAVATING TOOL WITH CEMENTED TUNGSTEN CARBIDE INSERT AND RING

(75) Inventors: Joseph Fader, Abingdon, VA (US); Kenneth Monyak, Abingdon, VA (US); Daniel Mouthaan, Williamsburg, MI (US); Colin Norris, Tarro (AU)

(73) Assignee: Sandvik Intellectual Property AB, Sandviken (SE)

( * ) Notice: Subject to any disclaimer, the term of this patent is extended or adjusted under 35 U.S.C. 154(b) by 210 days.

(21) Appl. No.: 12/329,071

(22) Filed: Dec. 5, 2008

(65) Prior Publication Data

US 2009/0146490 A1 Jun. 11, 2009

Related U.S. Application Data

(60) Provisional application No. 60/996,788, filed on Dec. 5, 2007, provisional application No. 61/064,075, filed on Feb. 14, 2008.

(51) Int. Cl.
*E21C 35/18* (2006.01)

(52) U.S. Cl. ..... 299/105; 299/111; 299/113

(58) Field of Classification Search ..... 299/111, 299/110, 113, 112, 104, 105
See application file for complete search history.

(56) References Cited

U.S. PATENT DOCUMENTS

| | | | | |
|---|---|---|---|---|
| 3,627,381 | A | 12/1971 | Krekeler | |
| 4,682,987 | A | 7/1987 | Brady et al. | |
| 4,938,538 | A | 7/1990 | Larsson et al. | |
| 5,161,859 | A | 11/1992 | Larsson et al. | |
| 5,417,475 | A | 5/1995 | Graham et al. | |
| 6,739,327 | B2 * | 5/2004 | Sollami | 299/113 |
| 6,758,530 | B2 | 7/2004 | Sollami | |
| 6,846,045 | B2 * | 1/2005 | Sollami | 299/113 |
| 7,204,560 | B2 * | 4/2007 | Mercier et al. | 299/105 |
| 7,530,642 | B2 * | 5/2009 | Ferreri et al. | 299/104 |
| 2003/0052530 | A1 * | 3/2003 | Sollami | 299/111 |
| 2003/0122414 | A1 * | 7/2003 | Sollami | 299/39.1 |
| 2003/0193235 | A1 * | 10/2003 | Sollami | 299/106 |
| 2008/0030066 | A1 * | 2/2008 | Mercier et al. | 299/105 |
| 2008/0164747 | A1 * | 7/2008 | Weaver et al. | 299/113 |

FOREIGN PATENT DOCUMENTS

| | | |
|---|---|---|
| DE | 24 42 146 | 3/1976 |
| DE | 30 05 684 | 8/1981 |
| EP | 0 122 893 | 2/1989 |
| GB | 2 004 315 | 3/1979 |
| SU | 899916 | 5/1980 |

* cited by examiner

*Primary Examiner* — Frederick L Lagman
(74) *Attorney, Agent, or Firm* — Drinker Biddle & Reath LLP

(57) ABSTRACT

An exemplary breaking or excavating tool includes a body having a mounting end and a working end. A seating surface at the working end includes a cavity and axially projecting sidewalls formed integral to the body, an insert mounted within the cavity has a tip at an axially forwardmost end, a tapered forward surface, a side surface and a transition edge at an intersection of the forward surface and the side surface. A ring located radially outward of the projecting sidewalls is formed of a material harder than the body of the tool. The transition edge and an axially forwardmost surface of each of the sidewalls and the ring are arranged in an axially rearwardly extending stepped configuration. A material removal machine on which the breaking or excavating tool is mounted and a method of manufacturing the breaking or excavating tool are also disclosed.

24 Claims, 6 Drawing Sheets

BREAKING OR EXCAVATING TOOL WITH CEMENTED TUNGSTEN CARBIDE INSERT AND RING

RELATED APPLICATION DATA

This application claims priority under 35 U.S.C. §119(e) to U.S. Provisional Application No. 60/996,788, filed Dec. 5, 2007, and to U.S. Provisional Application No. 61/064,075, filed Feb. 14, 2008, the entire contents of each of these applications are incorporated herein by reference.

FIELD

The present disclosure relates to a breaking or excavating tool. In particular, the present disclosure relates to a breaking or excavating tool with a working end having a cemented carbide insert, a seat for the insert having projecting sidewalls and a ring of material harder than the body of the tool located radially outward of the projecting sidewalls, where the insert, the sidewalls and the ring are arranged in a rearwardly extending stepped configuration.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Tools for breaking or excavating with working inserts of hard metal have been produced in configurations which have a lower energy consumption for a given operating capability. Although the front tip of the insert is intended to provide the cutting or breaking action in these low energy tools, if the body exposed to impact or abrasion during operation of the tool is made of a softer material, the body is subject to wear and damage. One result of this wear and damage is to weaken the attachment of the insert. The tool then fails prematurely because the insert has been dislodged.

Currently there is no pick of this fashion suitable for hard cutting conditions (e.g. tunneling, trenching, etc. . . . ). Caps offer steel wash protection but do not tend to stay on their steel bodies in tough conditions. In one known tool, a ring is located on the front face of the body. However, the axial location of the ring over the insert makes penetration difficult because of the blunting of the tip. Blunt picks produce excessive dust, consume too much energy, produce more heat, and create extreme vibration.

There is a need for a breaking or excavating tool that would give the benefits of a cap and the holding power of an insert and be suitable for the toughest conditions while extending the life of the tool. In addition, blunting of the tool should be minimized for improved performance.

SUMMARY

An exemplary breaking or excavating tool comprises a body having a mounting end and a working end, a seating surface at the working end including a cavity and axially projecting sidewalls formed integral to the body, an insert mounted within the cavity having a tip at an axially forwardmost end, a tapered forward surface, a side surface and a transition edge at an intersection of the forward surface and the side surface, and a ring located radially outward of the projecting sidewalls, the ring formed of a material harder than the body of the tool, wherein the transition edge and an axially forwardmost surface of each of the sidewalls and the ring are arranged in an axially rearwardly extending stepped configuration.

An exemplary material removal machine comprises a rotatable member and one or more breaking or excavating tools mounted on the rotatable member, wherein the breaking or excavating tool, includes: a body having a mounting end and a working end, a seating surface at the working end including a cavity and axially projecting sidewalls formed integral to the body, an insert mounted within the cavity having a tip at an axially forwardmost end, a tapered forward surface, a side surface and a transition edge at an intersection of the forward surface and the side surface, and a ring located radially outward of the projecting sidewalls, the ring formed of a material harder than the body of the tool, wherein the transition edge and an axially forwardmost surface of each of the sidewalls and the ring are arranged in an axially rearwardly extending stepped configuration.

An exemplary method of manufacturing a breaking or excavating tool comprises forming a first seating surface at a working end of a body of the tool, the seating surface including a cavity and axially projecting sidewalls formed integral to the body; forming a second seating surface radially outward of the cavity of the first seating surface; mounting an insert to the first seating surface, the insert including a tip at an axially forwardmost end, a tapered forward surface, a side surface and a transition edge at an intersection of the forward surface and the side surface; and mounting a ring to the second seating surface, wherein the mounted ring is located radially outward of the projecting sidewalls and wherein the ring is formed of a material harder than the body of the tool, wherein the transition edge and an axially forwardmost surface of each of the sidewalls and the ring are arranged in an axially rearwardly extending stepped configuration.

Another exemplary breaking or excavating tool comprises a body having a mounting end and a working end, a seating surface at the working end including a cavity and axially projecting sidewalls formed integral to the body, an insert mounted within the cavity having a tip at an axially forwardmost end, a tapered forward surface, a side surface and a transition edge at an intersection of the forward surface and the side surface, and a ring located radially outward of the projecting sidewalls, the ring formed of a material harder than the body of the tool, wherein an axial position of the transition edge and an axial position of an axially forwardmost surface of the sidewalls are substantially the same.

Another exemplary method of manufacturing a breaking or excavating tool comprises forming a first seating surface at a working end of a body of the tool, the seating surface including a cavity and axially projecting sidewalls formed integral to the body, forming a second seating surface radially outward of the cavity of the first seating surface, mounting an insert to the first seating surface, the insert including a tip at an axially forwardmost end, a tapered forward surface, a side surface and a transition edge at an intersection of the forward surface and the side surface, and mounting a ring to the second seating surface, wherein the mounted ring is located radially outward of the projecting sidewalls and wherein the ring is formed of a material harder than the body of the tool, wherein an axial position of the transition edge and an axial position of an axially forwardmost surface of the sidewalls are substantially the same.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Exemplary embodiments of breaking and excavating tools have an insert at a working end and a mounting means, such as retainer sleeve or a retainer clip, at a mounting end. Inserts are formed of hard material, an example of which is cemented carbide.

Figure 1:
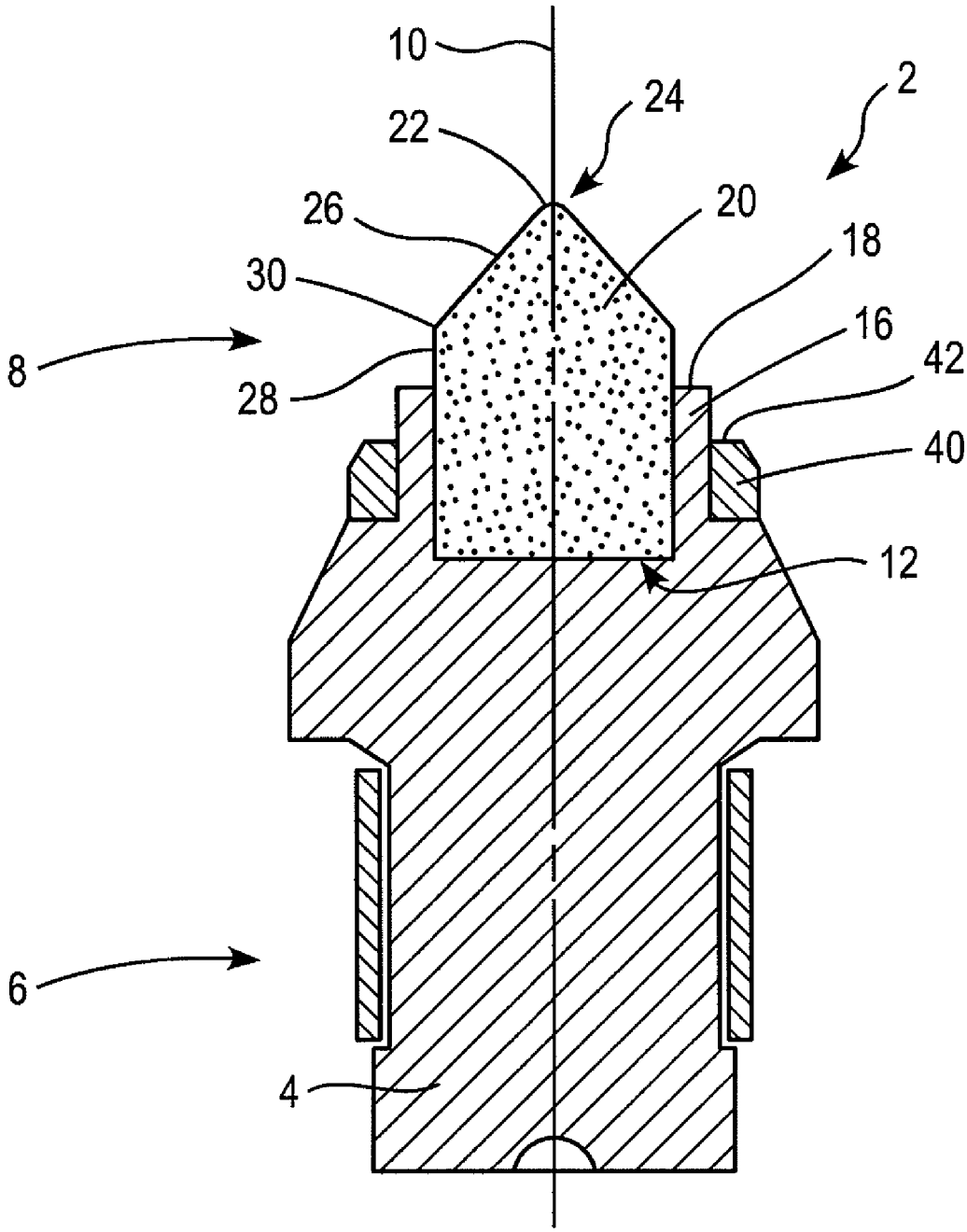
FIG. 1 shows a cross-sectional view of an exemplary embodiment of a breaking or excavating tool.

FIG. 1 shows a cross-sectional view of an exemplary embodiment of a breaking or excavating tool. The exemplary breaking or excavating tool 2 comprises a body 4 having a mounting end 6 and a working end 8 arranged longitudinally along axis 10. A seating surface 12 is located at the working end 8. The seating surface 12 includes a cavity 14 and axially projecting sidewalls 16. The sidewalls 16 are formed integral to the body 4 by suitable means, such as by machining or a combination of rough forming, by, for example, casting or forging, and machining. The sidewalls 16 have a front surface 18 that is substantially perpendicular to the axis 10.

An insert 20 is mounted within the cavity 12. An exemplary embodiment of an insert 20 has a tip 22 at an axially forwardmost end 24, a tapered forward surface 26, a side surface 28 and a transition edge 30 at an intersection of the forward surface 26 and the side surface 28.

A ring 40 is located radially outward of the projecting sidewalls 16. The ring 40 is the outermost radial feature at that longitudinal location along the axis 10 in that there is no portion of the body 4 that is radially outward from the outer diameter of the ring 40. An exemplary embodiment of a ring 40 has a front surface 42 that is substantially perpendicular to the axis 10. An exemplary embodiment of a ring 40 is formed of a material harder than the material forming the body of the tool, i.e., harder than the steel of body 4 and more particularly, harder than the material forming the projecting sidewalls 16.

Figure 2:
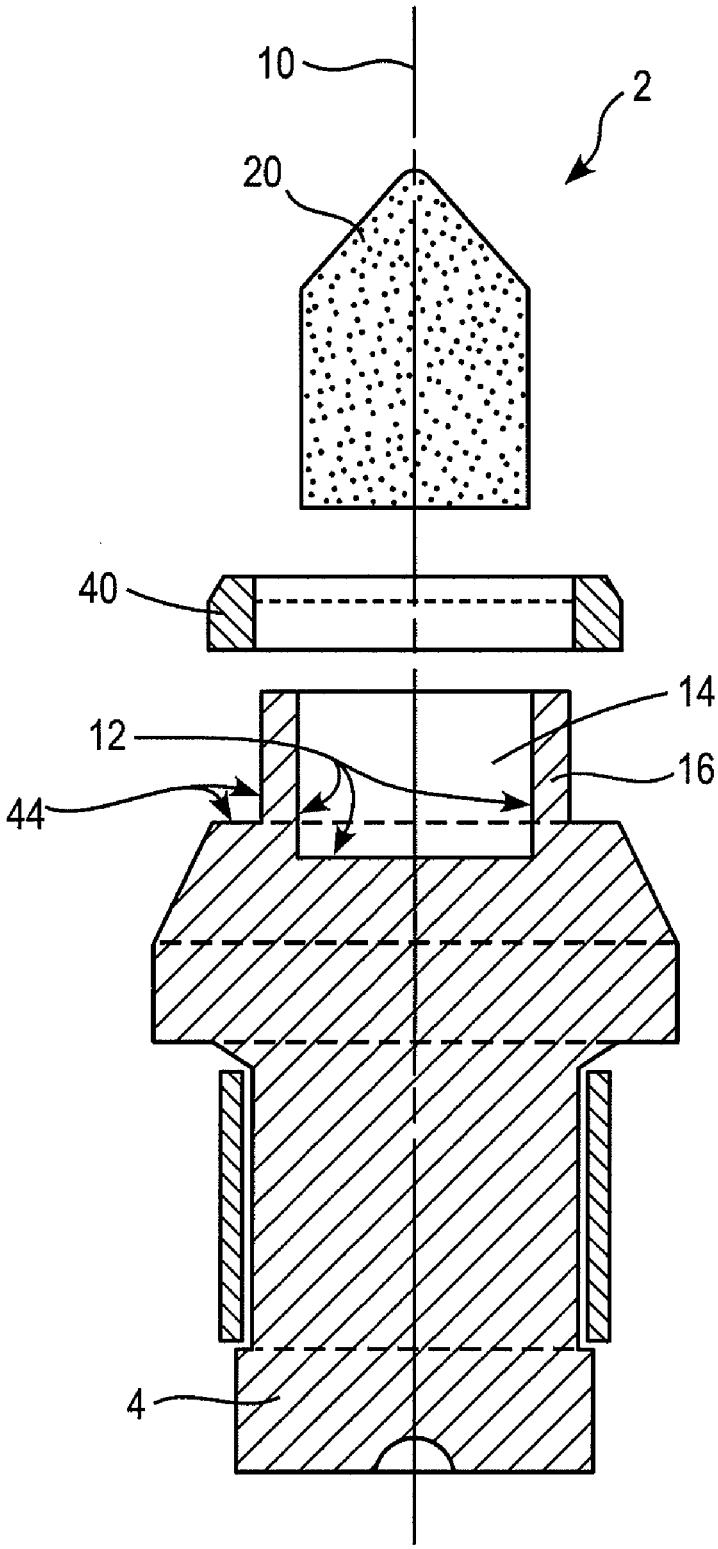
FIG. 2 shows a cross-sectional view of the breaking or excavating tool of FIG. 1 showing select components in an unassembled state.

Various components of the breaking and excavating tool 2, such as the seating surface 12, the cavity 14 and axially projecting sidewalls 16, are more clearly seen in FIG. 2, which shows a cross-sectional view of the breaking or excavating tool 2 of FIG. 1 in an unassembled state. Also shown in FIG. 2 is the seating surface 44 for the ring 40. As seen in FIG. 2, the seating surfaces 12 are a continuous cavity which provides enhanced support for the insert 20 against lateral forces perpendicular to the axis 10. Additionally, a continuous cavity provides beneficial flow of braze material during mounting of the insert 20.

Exemplary embodiments of the breaking or excavating tool can be included in a material removal machine. Examples of material removal machines include machines for underground mining, surface mining, trenching, road planning and/or reclaiming. For example, a material removal machine comprises a rotatable member and one or more breaking or excavating tools mounted on the rotatable member. The arrangement of the insert 20, the sidewalls 16 and the ring 40 are such that material removed by breaking or excavating activity employing the tool 2 is preferentially carried away and to the sides of the tool 2. Under such conditions, the removed material can wear the surfaces of the tool.

To promote extended life of the disclosed tool 2, the transition edge 30 and an axially forwardmost surface 18, 42 of each of the sidewalls 16 and the ring 40 are arranged in an axially rearwardly extending stepped configuration. In use, removed material will collect on the surfaces of the stepped configuration, such as forwardmost surface 18 of the sidewall 16 and forwardmost surface 42 of the ring. As more material is removed, this collected material is subject to wear and less of the surfaces of the working end 8 are subject to wear.

Figure 3:
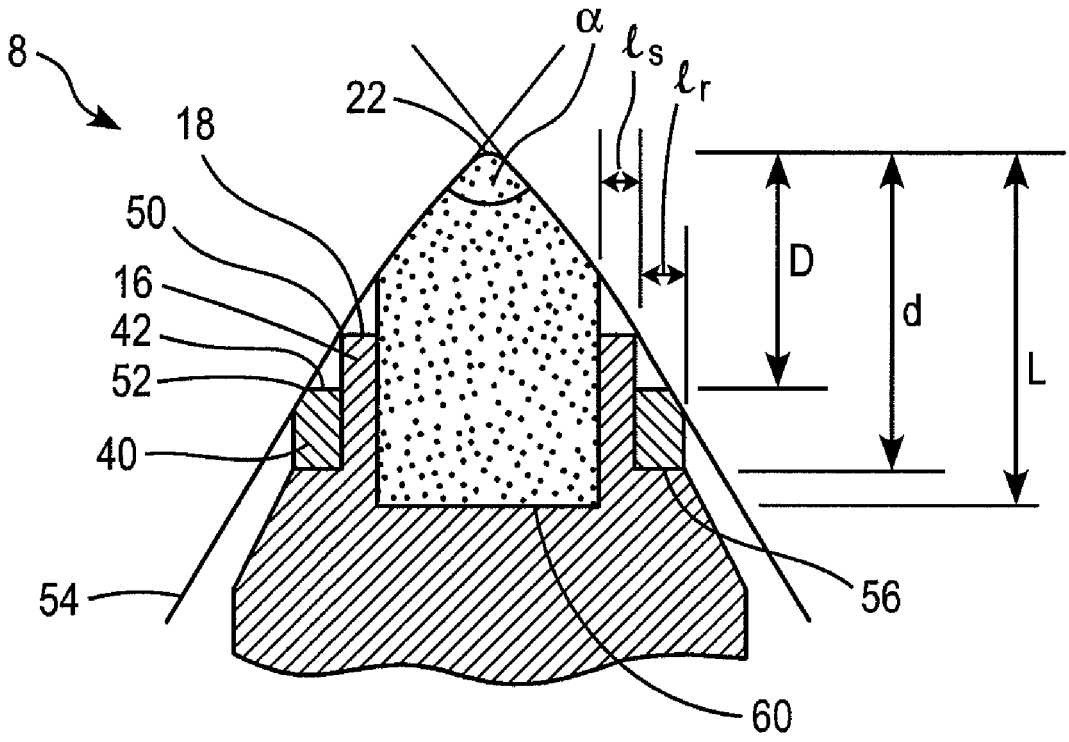
FIG. 3 shows a magnified cross-sectional view of the working end of the breaking or excavating tool of FIG. 1.

FIG. 3 shows a magnified cross-sectional view of the working end of the breaking or excavating tool of FIG. 1 and illustrates this stepped configuration. However, the profile of the stepped configuration is still within the ballistic envelop of the tool 2. For example, the transition edge 30, a radially outermost portion 50 of the axially forwardmost surface 18 of the sidewall 16 and a radially outermost portion 52 of the axially forwardmost surface 42 of the ring 40 are arranged on a ballistic envelop 54 of the tool 2. In exemplary embodiments, the ballistic envelop forms an angle $\alpha$ of about 60 degrees or less, alternatively 45 degrees to 60 degrees.

FIG. 3 also illustrates exemplary embodiments of the relative axial positions of the insert 20 and the ring 40 and the relative radial positions and thicknesses of the insert 20, the sidewalls 16 and the ring 40.

For example and in regard to the relative axial positions of the insert 20 and the ring 40, an axially rearwardmost surface 30 of the insert 20 is at an axial distance L from the tip 22 of the insert 20 and the axially forwardmost surface 42 of the ring 40 is at an axial distance D from the tip 22 of the insert 20. Exemplary embodiments maintain the relative axial positions of these features such that D is equal to or between 0.5L and 0.9L (i.e., $0.5L \leqq D \leqq 0.9L$), alternatively equal to or between 0.5L and 0.8L (i.e., $0.5L \leqq D \leqq 0.8L$), alternatively equal to or between 0.6L and 0.8L (i.e., $0.6L \leqq D \leqq 0.8L$). Furthermore, an axially rearwardmost surface 56 of the ring 40 is at an axial distance d from the tip 22 of the insert 20, and the relative axial positions of these features are such that d is greater than D and d is less than L, alternatively $d \leqq 0.9L$, alternatively $d \leqq 0.75L$. For example, in one exemplary embodiment, $0.5L \leqq D \leqq 0.8L$ and $d \leqq 0.9L$. The relative axial positions of the insert 20 and the ring 40 improve the seating of the insert 20 and provide improved support against forces applied to the insert during use.

As previously noted, the ring 40 is the outermost radial feature at that longitudinal location along the axis 10 in that there is no portion of the body 4 that is radially outward from the outer diameter of the ring 40. Thus, in the interval D to d, the ring 40 is the radially outermost portion of the tool 2. As shown in FIG. 3, the ring 40 is entirely within the axial extent of the insert such that the axially rearwardmost surface 30 of the insert 20 extends axially rearward past the ring 40 and another portion of the insert 20 extends axially forward past the axially forwardmost surface 42 of the ring 40.

In another example and in regard to the relative radial positions and thicknesses of the insert 20, the sidewalls 16 and the ring 40, a radial thickness of the sidewalls 16 is maximally $I_s$ and a radial thickness of the ring 40 is maximally $I_r$. Exemplary embodiments maintain the relative radial positions and thicknesses of these features such that $I_r$ is greater than or equal to $I_s$ (i.e., $I_r \geqq I_s$). The thickness $I_s$ of the sidewall 16 is sufficient, without the ring 40, to allow continued use of the breaking or excavating tool 2. Thus, if the ring is lost or otherwise is removed by, for example, fracture or wear, the insert 20 has sufficient support from the sidewalls 16 to continue cutting operations. As an example of a radial thickness of the sidewalls 16, an exemplary thickness is 1 mm$\leqq I_s \leqq$4 mm.

Figure 4:
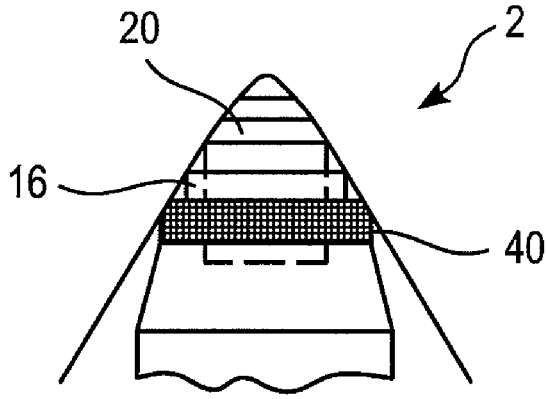
FIG. 4 shows a side view of an exemplary embodiment of the working end of the breaking or excavating tool of FIG. 1.

FIG. 4 shows a side view of an exemplary embodiment of the working end 8 of a breaking or excavating tool 2.

Figure 5:
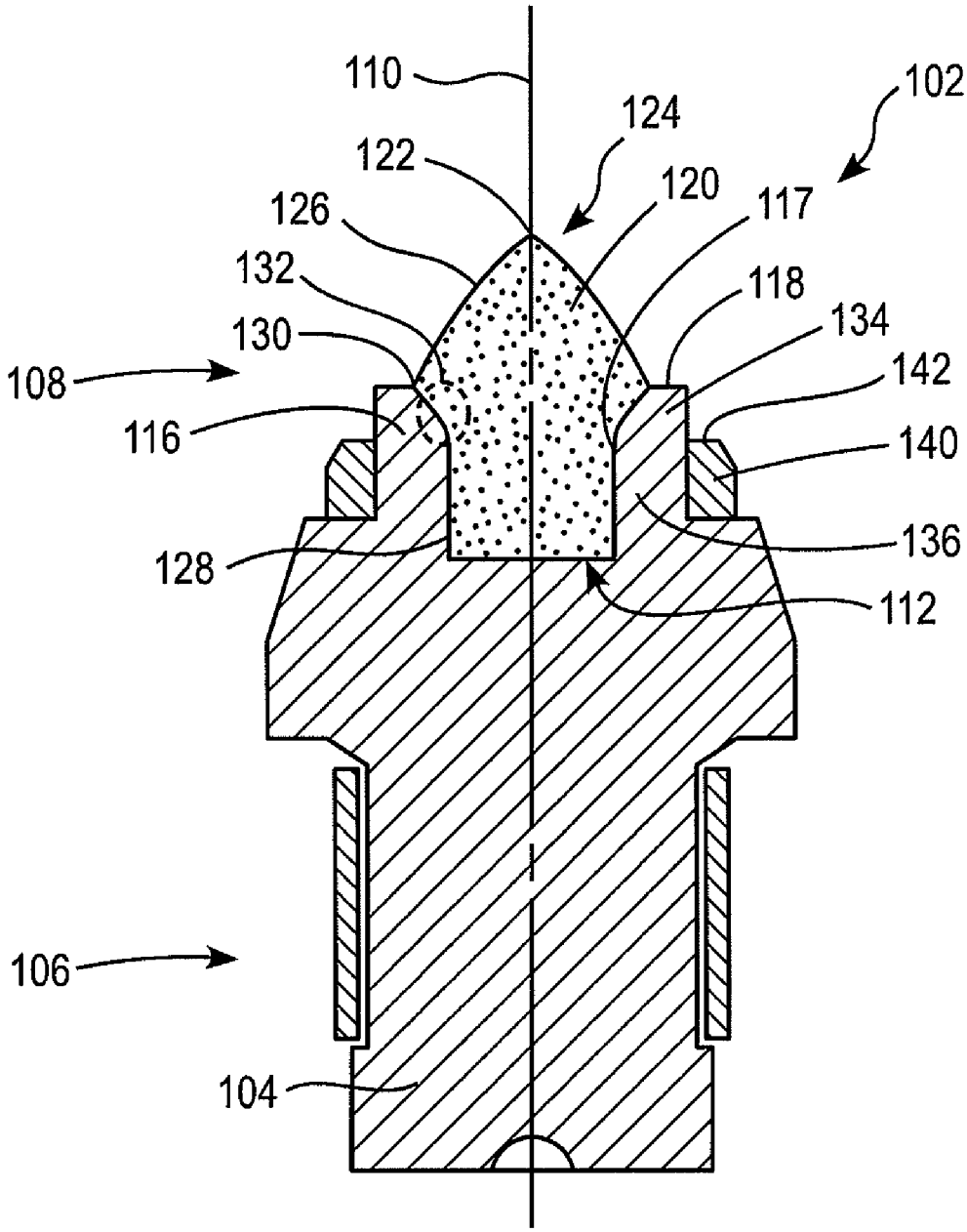
FIG. 5 shows a cross-sectional view of another exemplary embodiment of a breaking or excavating tool.

FIG. 5 shows a cross-sectional view of another exemplary embodiment of a breaking or excavating tool. The exemplary breaking or excavating tool 102 comprises a body 104 having a mounting end 106 and a working end 108 arranged longitudinally along axis 110. A seating surface 112 is located at the working end 108. The seating surface 112 includes a cavity 114 and axially projecting sidewalls 116. The sidewalls 116 are formed integral to the body 104 by suitable means, such as by machining or a combination of rough forming, by, for example, casting or forging, and machining. The sidewalls 116 have a front surface 118 that is substantially perpendicular to the axis 110. A radially inner surface 117 of the sidewalls serves as one of the seating surfaces 112.

An insert 120 is mounted within the cavity 112. An exemplary embodiment of an insert 120 has a tip 122 at an axially forwardmost end 124, a tapered forward surface 126, a side surface 128 and a transition edge 130 at an intersection of the forward surface 126 and the side surface 128. The insert 120 is mounted within the cavity 112 such that an axial position of the transition edge 130 and an axial position of an axially forwardmost surface 118 of the sidewalls 116 are substantially the same, i.e., within 1 mm of each other; alternatively, are at the same axial position.

Also, FIG. 5 illustrates the relative positions of the insert 120 and the radially inner wall 117 of the sidewalls 116. For example, a portion of the projecting sidewalls 116 undercuts the transition edge 130 of the insert 120 in a radially inward direction. In FIG. 5, the undercutting portion 132 is shown. The inner wall 117 has an initial section 134 that is reduced in thickness from a full thickness section 136 of the sidewall 116. This initial section 134 can, for example, be forwardly tapered. Alternative geometries can also be used, including curved configurations, curvilinear configurations or linear configurations that join the full thickness section 136 to the forwardmost surface 118. In complement to the different thicknesses axially along the inner wall 117 of the sidewalls 116, a radius of the side surface 128 of the insert 120 is less than a radius of the transition edge 130. Inclusion of the undercutting portion 132 and related geometry of the insert 120 and the sidewall 116 allows for less carbide to be used, thereby reducing expenses. However, at the same time the working surface of the insert 120 has not been appreciatively if at all reduced, so the tool retains its function. Further, the sidewall thickness has been increased, at least along a portion of the anchoring portion of the insert and therefore retention of the insert has increased.

A ring 140 is located radially outward of the projecting sidewalls 116. The ring 140 is the outermost radial feature at that longitudinal location along the axis 110 in that there is no portion of the body 104 that is radially outward from the outer diameter of the ring 140 at that location. An exemplary embodiment of a ring 140 has a front surface 142 that is substantially perpendicular to the axis 110. An exemplary embodiment of a ring 140 is formed of a material harder than the material forming the body of the tool, i.e., harder than the steel of body 104 and more particularly, harder than the material forming the projecting sidewalls 116.

Figure 6:
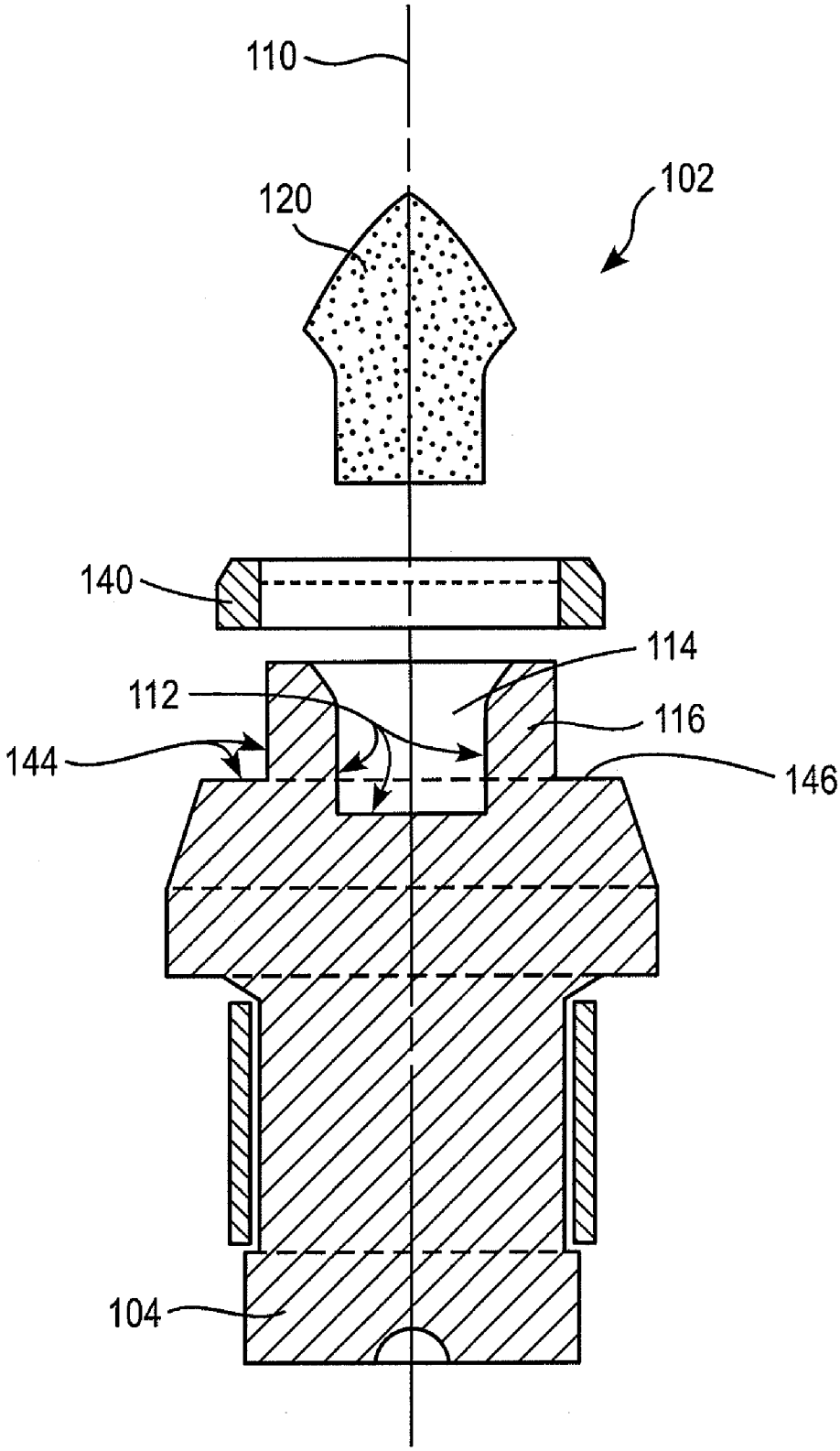
FIG. 6 shows a cross-sectional view of the breaking or excavating tool of FIG. 5 showing select components in an unassembled state.

Various components of the breaking and excavating tool 102, such as the seating surface 112, the cavity 114 and axially projecting sidewalls 116, are more clearly seen in FIG. 6, which shows a cross-sectional view of the breaking or excavating tool 102 of FIG. 5 in an unassembled state. Also shown in FIG. 6 is the seating surface 144 for the ring 140, which has a rearward surface 146 that projects radially further than the outer diameter of the ring 140. As seen in FIG. 6, the seating surfaces 112 are a continuous cavity which provides enhanced support for the insert 120 against lateral forces perpendicular to the axis 110. Additionally, a continuous cavity provides beneficial flow of braze material during mounting of the insert 120.

Exemplary embodiments of the breaking or excavating tool can be included in a material removal machine. Examples of material removal machines include machines for underground mining, surface mining, trenching, road planning and/or reclaiming. For example, a material removal machine comprises a rotatable member and one or more breaking or excavating tools mounted on the rotatable member. The arrangement of the insert 120, the sidewalls 116 and the ring 140 are such that material removed by breaking or excavating activity employing the tool 102 is preferentially carried away and to the sides of the tool 102. Under such conditions, the removed material can wear the surfaces of the tool.

To promote extended life of the disclosed tool 102, the transition edge 130 and a portion of the tapered forward surface 126 are inside a ballistic envelop formed by the tip 122 of the insert 120, a radially outermost portion 150 of the axially forwardmost surface 118 of the sidewall 116 and the radially outermost portion 152 of the ring 140. In addition, the axially forwardmost surface 118, 142 of each of the sidewalls 116 and the ring 140 are arranged in an axially rearwardly extending stepped configuration. In use, removed material will collect on the surfaces of the stepped configuration, such as forwardmost surface 118 of the sidewall 116 and forwardmost surface 142 of the ring 140. As more material is removed, this collected material is subject to wear and less of the surfaces of the working end 108 are subject to wear.

Figure 7:
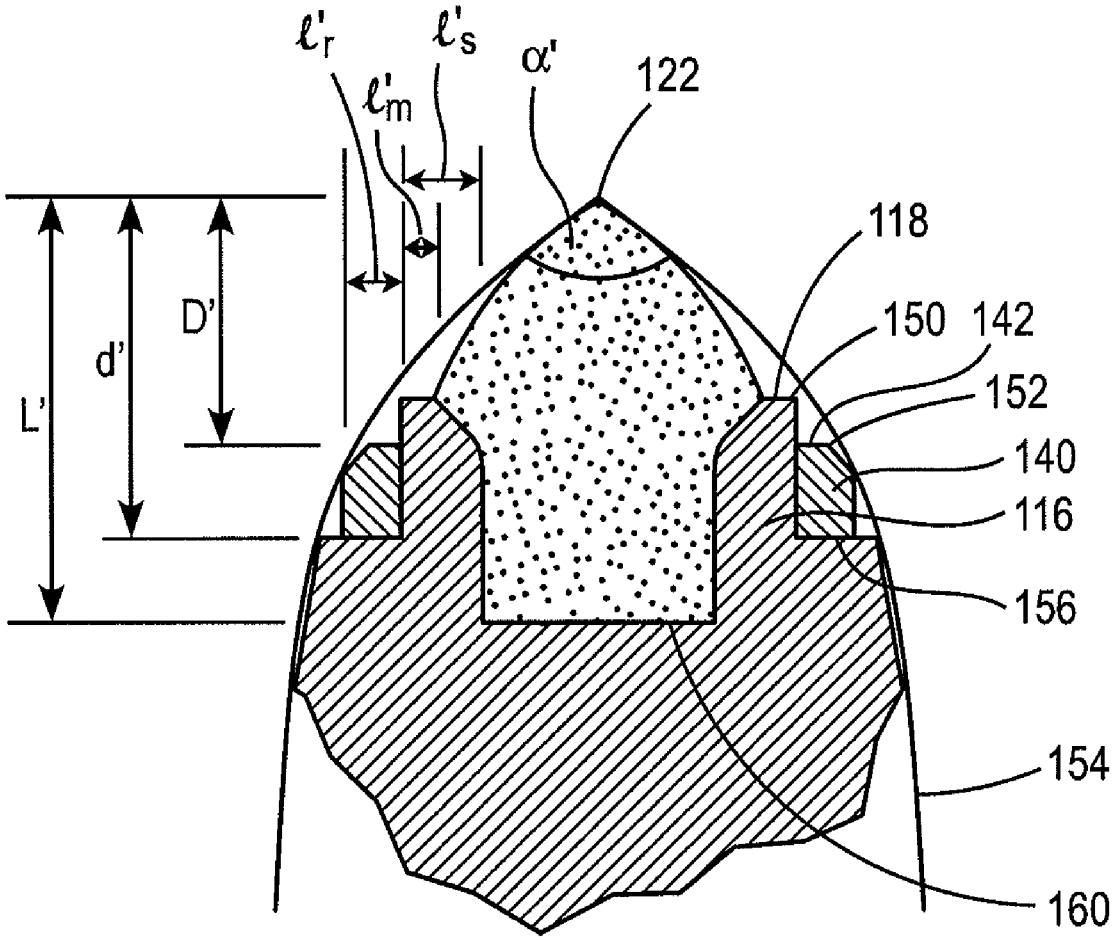
FIG. 7 shows a magnified cross-sectional view of the working end of the breaking or excavating tool of FIG. 5.

FIG. 7 shows a magnified cross-sectional view of the working end of the breaking or excavating tool of FIG. 5 and illustrates the ballistic envelop and the stepped configuration. For example, the tip 122, a radially outermost portion 150 of the axially forwardmost surface 118 of the sidewall 116 and a radially outermost portion 152 of the axially forwardmost surface 142 of the ring 140 are arranged on a ballistic envelop 154 of the tool 102. In exemplary embodiments, the ballistic envelop 154 forms an angle $\alpha'$ of about 60 degrees or less, alternatively 45 degrees to 60 degrees. The profile of the stepped configuration is still within the ballistic envelop 154 of the tool 102.

FIG. 7 also illustrates exemplary embodiments of the relative axial positions of the insert 120 and the ring 140 and the relative radial positions and thicknesses of the insert 120, the sidewalls 116 and the ring 140.

For example and in regard to the relative axial positions of the insert 120 and the ring 140, an axially rearwardmost surface 130 of the insert 120 is at an axial distance L' from the tip 122 of the insert 120 and the axially forwardmost surface 142 of the ring 140 is at an axial distance D' from the tip 122 of the insert 120. Exemplary embodiments maintain the relative axial positions of these features such that D' is equal to or between 0.5L' and 0.9L' (i.e., $0.5L' \leqq D' \leqq 0.9L'$), alternatively equal to or between 0.5L' and 0.8L' (i.e., 0.5L'≦D'≦0.8L'), alternatively equal to or between 0.6L' and 0.8L' (i.e., 0.6L'≦D'≦0.8L'). Furthermore, an axially rearwardmost surface 156 of the ring 140 is at an axial distance d' from the tip 122 of the insert 120, and the relative axial positions of these features are such that d' is greater than D' and d' is less than L', alternatively d'≦0.9L', alternatively d'≦0.75L'. For example, in one exemplary embodiment, 0.5L'≦D'≦0.8L' and d'≦0.9L'. The relative axial positions of the insert 120 and the ring 140 improve the seating of the insert 120 and provide improved support against forces applied to the insert during use.

As previously noted, in this exemplary embodiment the ring 140 is the outermost radial feature at that longitudinal location along the axis 110 in that there is no portion of the body 104 that is radially outward from the outer diameter of the ring 140 at that location. Thus, in the interval D' to d', the ring 140 is the radially outermost portion of the tool 102. As shown in FIG. 7, the ring 140 is entirely within the axial extent of the insert such that the axially rearwardmost surface 130 of the insert 120 extends axially rearward past the ring 140 and another portion of the insert 120 extends axially forward past the axially forwardmost surface 142 of the ring 140.

In another example and in regard to the relative radial positions and thicknesses of the insert 120, the sidewalls 116 and the ring 140, a radial thickness of the sidewalls 116 is maximally $I'_s$ and a radial thickness of the ring 140 is maximally $I'_r$. Exemplary embodiments maintain the relative radial positions and thicknesses of these features such that $I'_r$ is greater than or equal to $I'_s$ (i.e., $I'_r \geqq I'_s$). The thickness $I'_s$ of the sidewall 116 is sufficient, without the ring 140, to allow continued use of the breaking or excavating tool 102. Thus, if the ring is lost or otherwise is removed by, for example, fracture or wear, the insert 120 has sufficient support from the sidewalls 116 to continue cutting operations. As an example of a radial thickness of the sidewalls 116, an exemplary thickness is 1 mm≦$I'_s$≦4 mm, alternatively 2 mm≦$I'_s$≦4 mm. The minimum thickness of the sidewall $I'_m$ is preferably 1 mm; this will generally occur at the initial section 134 that is reduced in thickness, but can be less if sufficient stabilization and anchoring of the insert in the cavity is provided by the remaining portions of the sidewalls.

The exemplary breaking or excavating tools disclosed herein can be manufactured by any suitable technique. In one exemplary method of manufacturing, the method comprises forming a first seating surface at a working end of a body of the tool, the seating surface including a cavity and axially projecting sidewalls formed integral to the body, and forming a second seating surface radially outward of the cavity of the first seating surface. The forming of the first and second seating surface can be by machining or a combination of rough forming, by, for example, casting or forging, and machining.

The method of manufacturing also comprises mounting an insert to the first seating surface, and mounting a ring to the second seating surface. The mounted ring is located radially outward of the projecting sidewalls and the transition edge and an axially forwardmost surface of each of the sidewalls and the ring are arranged in an axially rearwardly extending stepped configuration. In exemplary embodiments, at least one of mounting the insert and mounting the ring includes a full braze at the intersection of the insert and/or ring and the respective seating surface.

The components and features of the disclosed breaking or excavating tool provide enhanced performance over conventional designs including reduced drag, easier penetration, less production of dust, reduced energy consumption, lower heat production, and minimized vibration. In addition, the components and features in FIGS. 5-7 produce these beneficial effects while reducing the amount of carbide used in the insert.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A breaking or excavating tool, comprising:

a body having a mounting end and a working end;

a seating surface at the working end including a cavity and axially projecting sidewalls formed integral to the body, the sidewalls having an axially forwardmost surface oriented perpendicular to an axis of the tool adjoining a radially outermost surface oriented parallel to the axis of the tool;

an insert mounted within the cavity having a tip at an axially forwardmost end, a convex tapered forward surface, a concave side surface, and a transition edge at an intersection of the convex forward surface and the concave side surface; and a ring located radially outward of the projecting sidewalls the ring formed of a material harder than the body of the tool, wherein an axial position of the transition edge and an axial position of the axially forwardmost surface of the sidewalls are substantially the same.

2. The tool according to claim 1, wherein a portion of the projecting sidewalls undercuts the transition edge of the insert in a radially inward direction.

3. The tool according to claim 2, wherein a radius of the side surface of the insert is less than a radius of the transition edge.

4. The tool according to claim 1, wherein the axially forwardmost surface of the sidewalls and the ring are arranged in an axially rearwardly extending stepped configuration.

5. The tool according to claim 1, wherein an axially rearwardmost surface of the insert is at an axial distance L from the tip of the insert, wherein the axially forwardmost surface of the ring is at an axial distance D from the tip of the insert, and wherein 0.5L≦D≦0.91L.

6. The tool according to claim 5, wherein 0.5L≦D≦0.8L.

7. The tool according to claim 5, wherein an axially rearwardmost surface of the ring is at an axial distance d from the tip of the insert, and wherein d is greater than D and d is less than L.

8. The tool according to claim 7, wherein in the interval D to d, the ring is the radially outermost portion of the tool.

9. The tool according to claim 7, wherein 0.5L≦D≦0.9L and wherein d≦0.9L.

10. The tool according to claim 1, wherein a radial thickness of the sidewalls is maximally $l_S$, wherein a radial thickness of the ring is maximally $l_r$, and wherein $l_r$ is greater than or equal to $l_S$.

11. The tool according to claim 10, wherein 1 mm≦$I_S$≦4 mm.

12. The tool according to claim 1, wherein the transition edge and a portion of the tapered forward surface are inside a ballistic envelop formed by the tip of the insert, a radially outermost portion of the axially forwardmost surface of the sidewalls and the ring.

13. The tool according to claim 12, wherein the ballistic envelop forms an angle of about 60 degrees or less.

14. The tool according to claim 1, wherein the insert is mounted, in the cavity with a full braze.

15. A method of manufacturing a breaking or excavating tool, the method comprising:

forming a first seating surface at a working end of a body of the tool, the seating surface including a cavity and axially projecting sidewalls formed integral to the body, the sidewalls having an axially forwardmost surface oriented perpendicular to an axis of the tool adjoining a radially outermost surface oriented parallel to the axis of the tool;

forming a second seating surface radially outward of the cavity of the first seating surface;

mounting an insert to the first seating surface, the insert including a tip at an axially forwardmost end, a tapered convex forward surface, a concave side surface, and a transition edge at an intersection of the convex forward surface and the concave side surface; and mounting a ring to the second seating surface, wherein the mounted ring is located radially outward of the projecting sidewalls and wherein the ring is formed of a material harder than the body of the tool, wherein an axial position of the transition edge and an axial position of the axially forwardmost surface of the sidewalls are substantially the same.

16. The method according to claim 15, wherein a portion of the projecting sidewalls undercuts the transition edge of the insert in a radially inward direction.

17. The method according to claim 16, wherein a radius of the side surface of the insert is less than a radius of the transition edge.

18. The method according to claim 15, wherein the axially forwardmost surface of the sidewalls and the ring are arranged, in an axially rearwardly extending stepped configuration.

19. The method according to claim 18, wherein at least one of mounting the insert and mounting the ring includes a full braze.

20. The method according to claim 18, wherein an axially rearwardmost surface of the insert is at an axial distance L' from the tip of the insert, wherein the axially forwardmost surface of the ring is at an axial distance D' from the tip of the insert, and wherein $0.5L \leqq D' \leqq 0.9L$.

21. The method according to claim 15, wherein an axially rearwardmost surface of the ring is at an axial distance d' from the tip of the insert, and wherein d' is greater than D' and d' is less than L'.

22. The method according to claim 18, wherein the transition edge and a portion of the tapered forward surface are inside a ballistic envelop formed by the tip of the insert, a radially outermost portion of the axially forwardmost surface of the sidewalls and the ring.

23. The method according to claim 22, wherein the ballistic envelop forms an angle of about 60 degrees or less.

24. A breaking or excavating tool, comprising:

a body having a mounting end and a working end;

a seating surface at the working end including a cavity and axially projecting sidewalls formed integral to the body;

an insert mounted within the cavity having a tip at an axially forwardmost end, a tapered convex forward surface, a concave side surface, and a transition edge at an intersection of the convex forward surface and the concave side surface; and a ring located radially outward of the projecting sidewalls, the ring formed of a material harder than the body of the tool, wherein an axial position of the transition edge and an axial position of an axially forwardmost surface of the sidewalls are substantially the same; and wherein an axially rearwardmost surface of the insert is at an axial distance L from the tip of the insert, wherein an axially rearwardmost surface of the ring is at an axial distance d from the tip of the insert, and wherein d is less than L.

* * * * *